US006957025B1

(12) United States Patent
Sinn et al.

(10) Patent No.: US 6,957,025 B1
(45) Date of Patent: Oct. 18, 2005

(54) ORDERED SETS PRINTING WITH AUTOMATIC DUAL TRAYS SHEET FEEDING

(75) Inventors: Louis Sinn, La Verne, CA (US); Howard J. Ulm, La Verne, CA (US); Lily A. Ray, Altadena, CA (US); Ojeni P. Sammis, Glendale, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/847,151

(22) Filed: May 17, 2004

(51) Int. Cl.[7] ..... G03G 15/00
(52) U.S. Cl. ..... 399/84; 399/23; 399/45
(58) Field of Search ..... 399/16, 23, 45, 399/381–393, 66, 84; 270/1.01, 1.02

(56) References Cited

U.S. PATENT DOCUMENTS

| | | | | |
|---|---|---|---|---|
| 4,348,102 | A | 9/1982 | Sessink | 399/68 |
| 4,587,532 | A | 5/1986 | Asano | 346/134 |
| 4,757,348 | A * | 7/1988 | Rourke et al. | 399/84 |
| 4,847,656 | A * | 7/1989 | Kuno et al. | 399/84 |
| 4,974,019 | A | 11/1990 | Nishioka et al. | 399/23 |
| 5,389,969 | A | 2/1995 | Suzuki et al. | 348/223.1 |
| 5,488,458 | A | 1/1996 | Benedict et al. | 399/15 |
| 5,568,246 | A | 10/1996 | Keller et al. | 399/382 |
| 5,570,172 | A | 10/1996 | Acquaviva | 399/403 |
| 5,640,647 | A * | 6/1997 | Hube | 399/84 |
| 5,995,721 | A | 11/1999 | Rourke et al. | 358/1.15 |
| 2003/0095810 | A1 * | 5/2003 | Haines et al. | 399/84 |

* cited by examiner

*Primary Examiner*—Minh Chau

(57) ABSTRACT

Continuous "load while run" printing of ordered sets of plural different sheets in a defined order in a printer paper path is provided even where plural different sheet feeding trays are stacked with multiple such ordered sets, by additionally loading therein near the bottom of the stack in between said ordered sets a control sheet with optically detectable control indicia which is detected in a printer paper path as that control sheet fed out from a first substantially but not fully emptied sheet feeding tray. In response to that control sheet detection, the sheet feeding from that first sheet feeding tray is automatically stopped to allow the reloading of additional ordered sets therein, and sheet feeding of further said ordered sets is automatically started from a second sheet feeding tray provide said continuous printing of said ordered sets in said defined order.

5 Claims, 1 Drawing Sheet

ORDERED SETS PRINTING WITH AUTOMATIC DUAL TRAYS SHEET FEEDING

Figure 1:
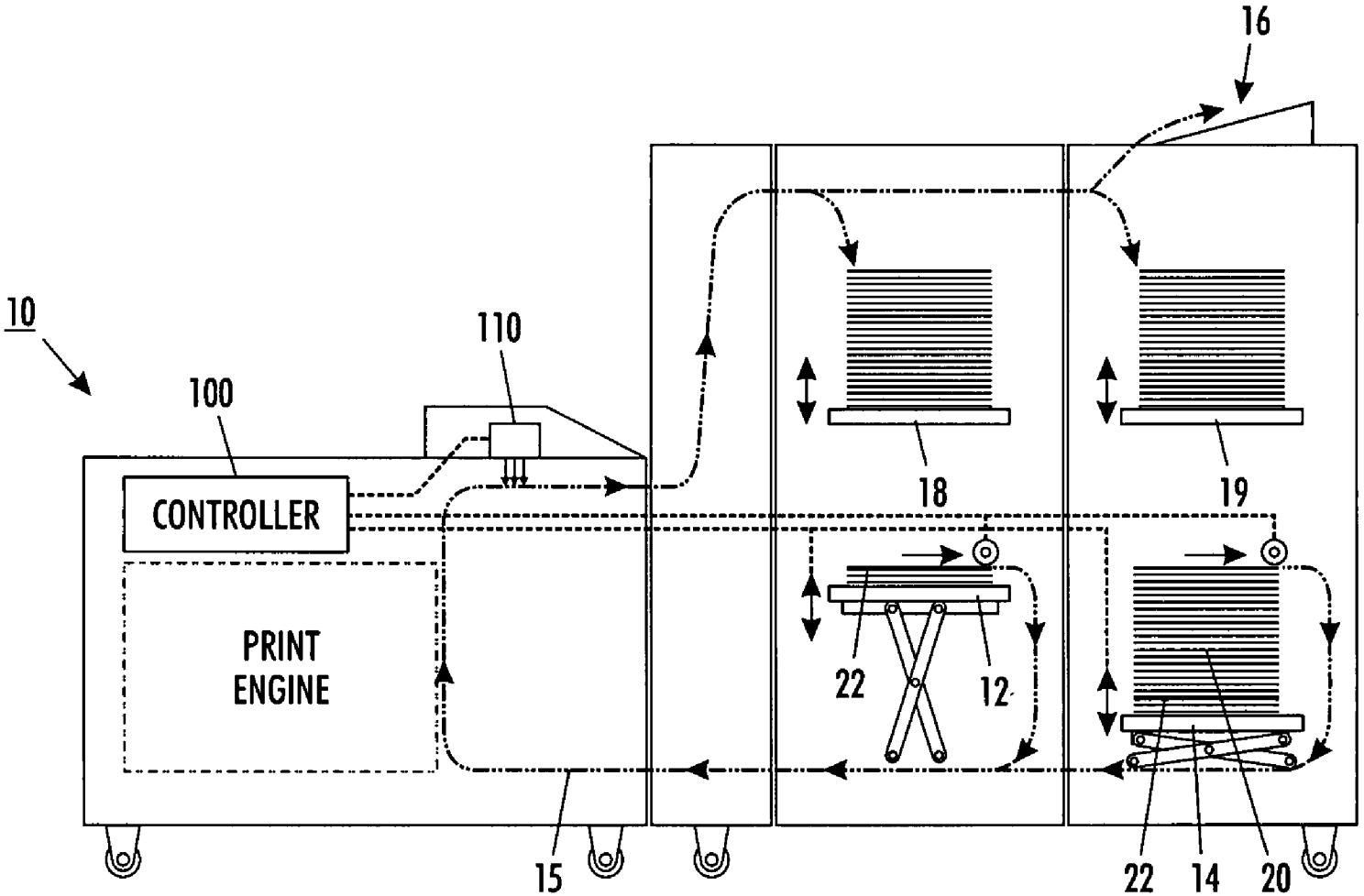

Disclosed in the embodiments herein is an improved system for "load while run" printing by automatic switchover and continued feeding from alternate sheet feed trays, even when the sheets being fed for printing are in multiple order-critical ordered sets, using a feeding switchover control independent of the normal low paper indicator signals that normally control the automatic switchover to feeding from the other sheet feed tray.

The known term "ordered sets" as used herein broadly encompasses various page-order sensitive printings of plural, plural-page documents. In particular, the printing of plural documents of plural sheets each in a defined sheet sequence of different colors, materials or pre-printed texts from the same sheet feed tray. That can include, for example, ordered tab stock printing, where each tabbed sheet within each completed document has a tab in a different transversely staggered position. Or, pre-inserted tabbed sheets, covers or color photographs being fed from the same stack from the same tray. The order of these different sheets within each multiple sheet document set must be maintained. Scrambled out of order sheets of final "ordered sets" product outputted from the printer will normally be unacceptable.

Yet the need to load ordered sets into a sheet feed tray of a printer is particularly likely to occur in so-called "hi-cap" (high capacity stacking) feeders typically used in longer print runs printing larger numbers of such "ordered sets" documents. The term "sheet feed trays" as used herein broadly includes discrete print media input sheet stacking and feeding stations of various types, internal or external, including, but not limited to, such "hi-cap" sheet stacking and feeding modules.

Furthermore, in longer print runs it is undesirable to have to frequently stop to reload new stacks of print media sheets into the same tray. Thus, it is well known in the art to provide "load while run" capability to higher volume printers. For example, Minolta U.S. Pat. No. 4,974,019 and earlier Xerox Corp. patents. This can provide automatic switching of the feeding of the print media sheets from a first sheet feed tray to a second sheet feed tray when the first sheet feed tray is, or is about to, run out of print media sheets, thus allowing printing of the same length print job to continue uninterrupted while the empty or near empty sheet feed tray is re-loaded. The sheet feeding trays being switched in between such "load while run" operation may both be "hi-cap" sheet feeding trays or modules.

However, sheet feeding trays do not all feed down to the very last sheet stacked in that tray before signaling that they are about to run out of more sheets to feed. In many machines they signal that condition while some variable number of sheets still remain in that tray. That may even be desirable for many "load while run" feed tray switchover continuous printing systems, because the last sheets feed are more likely to misfeed.

However, the inventors here have found that such "load while run" trays that do not always feed all of the sheets out of one tray before switching to feeding from another tray can effectively preclude the use of such printers in a "load while run" mode of operation for "ordered sets" documents. Doing so will result in the above-noted commercially unacceptable scrambled or unordered printed documents, by feeding only a partial ordered set from that first tray which will intermix with the complete ordered set fed from the other tray from which sheets are now feeding, and since the incoming print job signals or images to the printer have no way of knowing that has occurred, all of the subsequently printed documents will also be printed out of order.

As disclosed in the embodiment herein, it has been found that the insertion of an encoded "load while run" control sheet at the end of the last complete (intact) ordered set desired to be fed from the first sheet feed tray, and a sensing or detection system therefore, may be used to solve this problem by controlling the "load while run" tray switch-over at that point, rather than, as before, having the low paper signal from that tray controlling the feeding tray switchover, thus producing properly ordered sets of printed documents even in printing "ordered sets" in "load while run" mode.

By way of background as to the potential additional use of the disclosed system for consistent ordered sets printing using two integrated print engines, which may also be printing from different sheet feed trays, are the following references variously relating to what have been variously called "tandem engine" printers, "cluster printing," "output merger" systems, etc. For example, Xerox Corp. U.S. Pat. No. 5,568,246 issued Oct. 22, 1996, U.S. Pat. No. 6,608,988 B2 issued Aug. 19, 2003, and Canon Corp. U.S. Pat. No. 4,587,532.

Also of possible interest are Xerox Corp. U.S. Pat. No. 5,570,172 and U.S. Pat. No. 5,995,721. One example of an "interposer" (sheet inserter) patent is Xerox Corp. U.S. Pat. No. 5,389,969.

By way of background, there is some known use in the art of bar codes on print media sheets or insert sheets to control other, different, xerographic printing functions. For example, Sperry Corp. U.S. Pat. No. 4,348,102 prints discrete bar type codes on copy sheets in the process of duplex printing for pagination control information. Another duplex printing integrity system using marks on the sheets and an optical reader thereof is disclosed in Xerox Corp. U.S. Pat. No. 5,488,458 issued Jan. 30, 1996. Encoded sheets read by sensors are also known for xerographic "MICR" printing (magnetic ink numbers printing) of checks and other security documents for keeping track of the number of sheets being printed in order to prevent thefts or other inadvertent losses.

A specific feature of the specific embodiment disclosed herein is to provide a method of continuous output printing of ordered sets of plural different sheets in a defined order wherein said plural different sheet feeding trays are respectively loaded with plural said ordered sets of plural different sheets in said defined order and with at least one underlying control sheet with detectable control indicia comprising sequentially feeding said plural said plural different sheets of said plural ordered sets thereof from one said sheet feeding tray and then feeding said underlying control sheet, detecting said detectable indicia on said control sheet fed from said one sheet feeding tray in response to said detection of said detectable indicia on a said control sheet automatically switching of sheet feeding from said one sheet feeding tray to another said sheet feeding tray that is loaded with said plural said ordered sets of plural different sheets in said defined order to provide said continuous output printing of said ordered sets of plural different sheets in said defined order, and providing for reloading availability of said one sheet feeding tray with further said ordered sets of plural different sheets in said defined order.

Further specific features disclosed in the embodiment herein, individually or in combination, include those wherein said printing is accomplished in a printer paper path, and wherein said control sheet detectable indicia detecting step occurs in said printer paper path; and/or wherein said printing is accomplished in a printer paper path, wherein said control sheet detectable indicia detecting step occurs in said printer paper path, and further including automatic purging of sheets from said paper path that are not in said defined order in response to said detecting step; and/or a method of continuous load while run printing of ordered sets of plural different sheets in a defined order in a printer paper path of a printer with at least first and second different sheet feeding trays both stacked with multiple such ordered sets, by additionally loading a control sheet in said first and second sheet feeding trays at a location above the bottom of said stack by more sheets than the number of said plural sheets of a said ordered set, said control sheet having with optically detectable control indicia, detecting said detectable control indicia on said control sheet in said printer paper path as said control sheet is fed out from said first sheet feeding tray before said first sheet feeding tray is fully emptied, and in response to said control sheet detectable control indicia detection, automatically stopping sheet feeding from said first sheet feeding tray to allow reloading of additional ordered sets therein, and automatically starting sheet feeding of further said ordered sets from said second sheet feeding tray, to provide said continuous load while run printing of said ordered sets in said defined order; and/or a printer with a paper path and at least first and second sheet feeding trays in which said first and second sheet feeding trays may be loaded with plural sets of plural different sheets in a defined order and with at least one underlying control sheet with detectable control indicia to be fed into said paper path, said first and second sheet feeding trays having a tray empty signal generating system, said printer having an automatic load while run system operative independently of said tray empty signal generating system, said automatic load while run system including an optical detector in said paper path for detecting said detectable control indicia on said control sheet when said underlying control sheet is fed from said first sheet feeding tray and providing a switching signal, said automatic load while run system further including a controller for receiving said switching signal and in response thereto automatically switching the feeding of sheets into said paper path from said first sheet feeding tray to said second sheet feeding tray to provide continuous printing of said plural sets of plural different sheets in said defined order and reloading availability of said first sheet feeding tray with further said plural sets of plural different sheets in said defined order.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy." A "print job" is normally a set of related sheets, usually one or more collated copy sets copied from a set of original document sheets or electronic document page images, from a particular user, or otherwise related. A "simplex" document or copy sheet is one having its image and any page number on only one side or face of the sheet, whereas a "duplex" document or copy sheet has "pages," and normally images, on both sides, that is, each duplex sheet is considered to have two opposing sides or "pages" even though no physical page number may be present.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular sensors, component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, the present invention will be better understood from this description of this specific embodiment, including the drawing FIGURES (which are approximately to scale) wherein:

FIG. 1 is a schematic frontal perspective view of an exemplary commercial xerographic printer including an exemplary subject control system for "load while run" printing of ordered sets.

Describing now in further detail the exemplary embodiment with reference to the FIGURE, there is schematically shown a reproduction machine 10, by way of one example thereof. In this example this machine 10 is a Xerox Corp. "DocuPrint"™ DP180 & 4634 class of xerographic printer, with at least two high-capacity sheet feed trays 12 and 14, a paper path 15, a purge tray 16 and one or two printed sheet outputs 18 and 19 [here Bins A and B]. As is also the case with some other types of printers, the printer 10 leaves some unfed sheets in its elevator stacking trays 12 and 14 whenever either of those two trays automatically provide a signal to reload, and automatically lowers that particular elevator stacking tray 12 or 14 for reloading. That can end the feeding of an ordered set 20 therein in the middle of the set or anywhere partly through the ordered set.

Thus, to avoid that problem, the customer currently has to stop the printing and manually remove all the remaining sheets in that tray and place those partial set sheets on the top of the ordered sheets previously loaded (stacked) in other (next available) tray, before the print job can be continued.

In contrast, in the embodiment herein, this problem can be solved with only a few commercial Xerox Corp. XSIS controller 100 software changes in NVRAM, or the main printer controller, and the presence or installation of the Xerox Corp. commercial Bar Code Reader Kit 110 at any suitable position in the printer 10 paper path (normally used for a different function, as described above). The bar code reader 110 can detect in a known manner a bar code on a control sheet 22, which can be the last page of each ordered set, or a special control sheet 22 loaded near the bottom of the stack. Especially where more than two hi-cap feeders are being automatically controlled in a load while run mode, the printed bar code control sheet can be placed, for example, at the bottom of a complete ordered set more than 15 sheets from the bottom sheet of the stack to insure that the control sheet 22 at its detection location in the downstream paper path 22 will trigger the below new "load while run" mode of operation before the tray's existing low paper sensor is triggered to trigger the existing old "load while run" mode of operation.

The controller 100 can then signal from the control sheet 22 detection a bar code fault signal which can force the printer 10 into a page recovery mode, and send any inappropriate sheets of a partial ordered set in the paper path 15 to the existing purge tray 16. During this automatic recovery period, of for example approximately 40 seconds, the controller 100 is programmed to send a signal to lower the active (feeding) tray for loading and to enable feeding from the other tray. The printer 10 will thus automatically resume feeding and printing from the start (first sheet) of the next ordered set in that other tray, thus providing automatic "load while run" capability in spite of the requirement for ordered sets feeding and printing. Providing the desired continued printing automatically while the operator loads the now loadable tray or trays.

As an alternative, the control sheet 100 can have other triggering indicia, and the optical detector can be different or simpler. For example, glyphs or other optically readable marks on paper, or even commercially available 3-hole punched paper sheets or transparencies with opaque edges.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of continuous output printing of ordered sets of plural different sheets in a defined order wherein plural different sheet feeding trays are respectively loaded with plural said ordered sets of plural different sheets in said defined order and with at least one underlying control sheet with detectable control indicia, comprising:

sequentially feeding said plural different sheets of said plural ordered sets thereof from one said sheet feeding tray and then feeding said underlying control sheet, detecting said detectable indicia on said underlying control sheet fed from said one sheet feeding tray, in response to said detection of said detectable indicia on said underlying control sheet automatically switching sheet feeding from one said sheet feeding tray to another said sheet feeding tray that is loaded with said plural said ordered sets of plural different sheets in said defined order to provide said continuous output printing of said ordered sets of plural different sheets in said defined order, and providing for reloading availability of said one sheet feeding tray with further said ordered sets of plural different sheets in said defined order.

2. The method of continuous output printing of ordered sets of plural different sheets in a defined order of claim 1, wherein said printing is accomplished in a printer paper path, and wherein said underlying control sheet detectable indicia detecting step occurs in said printer paper path.

3. The method of continuous output printing of ordered sets of plural different sheets in a defined order of claim 1, wherein said printing is accomplished in a printer paper path, wherein said underlying control sheet detectable indicia detecting step occurs in said printer paper path, and further including automatic purging of sheets from said paper path that are not in said defined order in response to said detecting step.

4. A method of continuous load while run printing of ordered sets of plural different sheets in a defined order in a printer paper path of a printer with at least first and second different sheet feeding trays both stacked with multiple such ordered sets, by additionally loading a control sheet in said first and second sheet feeding trays at a location above the bottom of said stack by more sheets than the number of said plural sheets of a said ordered set, said control sheet having optically detectable control indicia, detecting said optically detectable control indicia on said control sheet in said printer paper path as said control sheet is fed out from said first sheet feeding tray before said first sheet feeding tray is fully emptied, and in response to said control sheet detectable control indicia detection, automatically stopping sheet feeding from said first sheet feeding tray to allow reloading of additional ordered sets therein, and automatically starting sheet feeding of further said ordered sets from said second sheet feeding tray, to provide said continuous load while run printing of said ordered sets in said defined order.

5. A printer with a paper path and at least first and second sheet feeding trays in which said first and second sheet feeding trays are capable of being loaded with plural sets of plural different sheets in a defined order and with at least one underlying control sheet with detectable control indicia to be fed into said paper path, said first and second sheet feeding trays having a tray empty signal generating system, said printer having an automatic load while run system operative independently of said tray empty signal generating system, said automatic load while run system including an optical detector in said paper path for detecting said detectable control indicia on said underlying control sheet when said underlying control sheet is fed from said first sheet feeding tray and providing a switching signal, said automatic load while run system further including a controller for receiving said switching signal and in response thereto automatically switching the feeding of sheets into said paper path from said first sheet feeding tray to said second sheet feeding tray to provide continuous printing of said plural sets of plural different sheets in said defined order and reloading availability of said first sheet feeding tray with further said plural sets of plural different sheets in said defined order.

* * * * *